United States Patent [19]

Bühler et al.

[11] 4,162,061

[45] Jul. 24, 1979

[54] COOLING ELEMENT FOR A METALLURGICAL FURNACE

[75] Inventors: Hans-Eugen Bühler, Rheurdt; Günter Robusch, Essen; Herbert Schäfer, Dinslaken; Karl-Heinz Peters, Duisburg, all of Fed. Rep. of Germany

[73] Assignee: Thyssen Aktiengesellschaft vorm. August Thyssen-Hütte, Duisburg, Fed. Rep. of Germany

[21] Appl. No.: 896,795

[22] Filed: Apr. 17, 1978

[30] Foreign Application Priority Data

Apr. 29, 1977 [DE] Fed. Rep. of Germany ..... 2719165

[51] Int. Cl.[2] ..... C21B 7/10

[52] U.S. Cl. ..... 266/193; 122/6 B

[58] Field of Search ..... 122/6 B; 266/190, 193, 266/194

[56] References Cited

U.S. PATENT DOCUMENTS 4,004,790 1/1977 Krol et al. ..... 266/193

FOREIGN PATENT DOCUMENTS 48-26564 8/1973 Japan ..... 266/193

545676 4/1977 U.S.S.R. ..... 266/193

OTHER PUBLICATIONS

Iron and Steel Engineer; vol. 49, No. 11, Nov. 1972.

*Primary Examiner*—Gerald A. Dost

*Attorney, Agent, or Firm*—J. Harold Nissen

[57] ABSTRACT

Cooling element for a metallurgical furnace having steel tubes for conveying a cooling medium and a refractory lining which is anchored to the front surface of the cast iron body on the furnace side thereof in recesses which run parallel to the wide side of the cooling element. The recesses have a cross-section which widens out starting from the front surface of the cast iron body towards the inside of the cooling element and the refractory lining is inserted into the recess.

11 Claims, 3 Drawing Figures

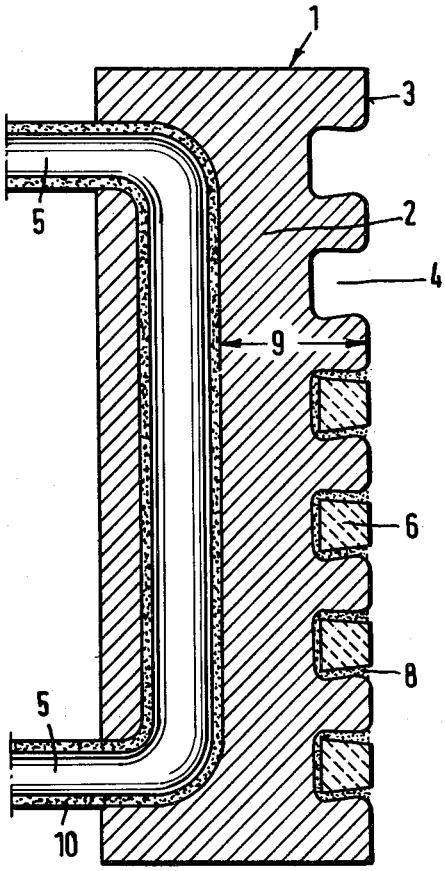
Fig.1
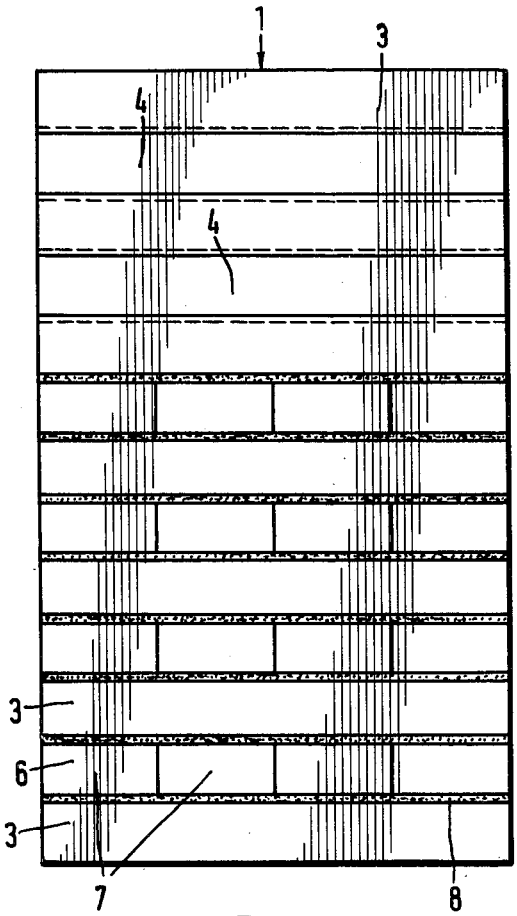
Fig.2
Fig.3
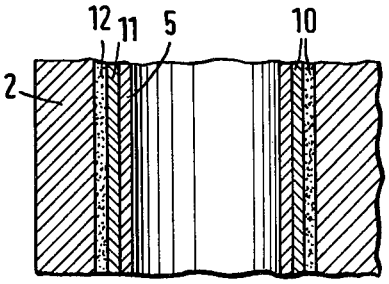

COOLING ELEMENT FOR A METALLURGICAL FURNACE

CROSS REFERENCE TO RELATED APPLICATIONS

The invention disclosed in this application is related to the invention disclosed in Application Ser. No. 896,794, filed Apr. 17, 1978 in the name of Hans Eugen Buhler et al and is based on West German Patent Applications P 2717641.6 filed April 21, 1977 and P 2719166.8 filed April 29, 1977.

BACKGROUND OF THE INVENTION

This invention relates to a cooling element for a metallurgical furnace. More particularly, the invention is concerned with a cooling element for a metallurgical furnace which is provided with steel tubes for the conveyance of a cooling medium and includes a refractory lining facing the interior of the furnace.

DESCRIPTION OF THE PRIOR ART

The known cooling elements are composed of steel tubes which are cast integrally with a cast iron body and have a refractory lining associated therewith. Such cooling elements are normally rectangular in shape and are used in particular in blast furnaces.

German utility model No. 73 31,936 discloses a cooling element having a refractory lining arranged on the front surface of the side facing the interior of the furnace. This refractory lining is held in recesses which run parallel to the wide side of the cooling element in order to reduce the heat flux density flowing out of the furnace onto the cooling element. In this prior art, the connection between the refractory lining and the cast iron body is produced during the casting of the cast iron body by integrally casting the refractory lining. The refractory lining projects over the front surface of the cast iron body towards the inside of the furnace.

The refractory lining tapers towards the inside of the cooling element and is held in position by means of a tongue and groove connection. The refractory lining which projects over the cast iron body should serve to anchor a refractory mass which is to be applied. As stresses in the cast iron body occur and can not be avoided when such a cooling element cools, there is the danger of the integrally cast part of the refractory lining being destroyed while the cast body is cooling. There is also danger here of the refractory material bursting when the cooling element is being cast due to the fact that it lacks resistance to changes in temperature.

It is therefore an object of the present invention to provide a cooling element having a refractory lining which cooperates with the cooling element to accommodate changes in temperature, and thereby extend the working life of the cooling element. Furthermore, it is desirable that the refractory lining be applied easily.

SUMMARY OF THE INVENTION

The present invention proposes to solve the aforesaid problems by providing a cooling element having recesses with a cross-section which widens out starting from the front surface of the cast iron body towards the inside of the cooling element. Further, the present invention proposes that the refractory lining be inserted into the recess and be held thereby. The variation of the width of the cross-section can be achieved in a simple manner. Moreover, it is possible to widen the cross-section in such a manner that it can be formed substantially in the shape of a "T". In this way, the head or cross-piece of the "T" is formed innermost of the recess and the stem or leg of the "T" extends within the recess up to the front surface of the cooling element. The refractory lining can then be formed with portions which are received within the "T" shaped cross-section and held thereby. The refractory lining is composed of one or more bricks. Several bricks are usually inserted into each recess. The recesses usually extend in a parallel direction in the form of rows and in a direction parallel to the wide side of the cooling element, and a plurality of the bricks are usually inserted into each of the recesses to thereby form the refractory lining.

A continuous widening of the cross-section is preferred, and therefore one speaks of a conical form of the cross-section, i.e. the stem or leg of the "T" widens conical from the front surface of the cast iron body towards the head or cross-piece, which is positioned in the innermost part of the recess. In other words according to this preferred embodiment the recess widens out in dovetailed manner from said front surface away therefrom. Details concerning the extent of the conical form are given below. During the assembly of the cast iron body with the lining, the bricks of the prepared refractory lining are inserted from a side of the cooling element into the recess parallel of the front surface and on the furnace side of the cooling element. For expedience, several individual bricks are inserted, usually one behind the other, into each of the recesses which run parallel to the wide side of the cooling element. The individual bricks as a unit then form the refractory lining for the respective row. The length of the brick is left to the specialist's discretion. However, it has proved expedient to work from a standardized length, e.g. 250 mm, as all possible purposes can be covered thereby.

In accordance with a particularly preferred embodiment, the cross-section of each individual brick corresponds to the cross-section of the recess. It must be taken into consideration here, that it is necessary to take a measurement which is somewhat short of that specified in order to be able to insert the brick into the recess. The short measurement must be coordinated with the widening cross-section so that the inserted individual brick can not become disengaged or dislodged from the cooling element in the direction of the inside of the furnace. A recess which widens out in a dovetailed manner is particularly preferred. With this dovetailed recess embodiment, it has proved expedient when the conical form is greater than 2% and less than 10%, and in particular in the range of 4% to 7%. The conical form is to be understood here as meaning half the difference of the width at the front surface of the recess and the width at the bottom surface of the recess. Working from this conical form it is recommended that the short measurement between the cast iron body and the individual brick amounts to less than 70%, and in particular less than 50%, of the chosen conical form. Thus, a short measurement or a gap width of 1 to 3.5 mm has proved especially expedient with a conical form of below 8 mm.

According to a preferred embodiment, the surface of the refractory lining terminates flush with the front surface of the cast iron body. It is advantageous if the front surface on the furnace side is formed from 30%–70% of the refractory lining and the remaining surface is formed from the cast iron body. A proportion of refractory lining and cast iron body of about 50% each is particularly advantageous. Therefore, strips of equal width of refractory lining and cast iron body are situated on the front surface from the top downwards. To facilitate matters, one can start with a first strip from the cast body, then it can be followed with a strip of lining, then a second strip of cast body and a second strip of lining, etc., with the lower end being a strip of the cast body. In this way, alternate rows of cast iron body and refractory lining are provided.

The particular depth of the recess in the cast iron body is essential for the proper functioning of the cooling element. The recess depth must be coordinated with the space or distance between the surface of the tube and the nearest front surface of the cast iron body facing the inside of the furnace. The depth of the recess can vary to between $\frac{1}{3}$ and $\frac{2}{3}$ of the aforementioned space or distance; a distance measurement of 45%–55% is particularly preferred. In a typical embodiment, for example, the space or distance between the surface of the tube and the front surface nearest the furnace varies between 110 mm and 140 mm. A depth of 65 mm to 78 mm is recommended for the recess when the spacing or distance is 140 mm.

The portion of the refractory lining which is received within the dovetailed recess may not be perfectly fitted and complementary thereto. To take care of any excess spacing between the refractory lining within the recess and the walls of the recess, an appropriate mortar is used. Accordingly, it has proved expedient to fill the short measurement between the recess in the cast iron body and the refractory lining or gap width with mortar. A mortar with sufficient solidity for transport is to be selected. Such mortars are available to the specialist. Within the group of these known mortars a chemically-bonding mortar is preferred. The chemically-bonding mortar has the advantage that it does not lose its effectiveness even in later use, i.e. at higher temperatures.

According to a further preferred solution, the cast iron body is composed to a low-alloyed cast iron with nodular graphite. The cast iron has a carbon content and should have a silicon content of at least 1.8%, in particular of 2.1% to 5.3% by weight. A silicon content of 2.2% to 3.5% is particularly preferred. The carbon content of the alloy can amount to between 2.5% and 4.0%. Carbon contents of 2.7% to 3.8% are preferred.

In relation to the conventional cast iron bodies with lamellar graphite, the cast iron body is composed of nodular graphite and has the particular advantage that it shows a higher degree of stability of volume. This is essential for the bond between the refractory lining and cast iron body as the cooling element shows a favorable consistancy in shape even with greater changes in temperature, and the cooling effect can be exercised better.

The cooling element according to the invention offers many advantages including the avoidance of the stressing of the bricks by pressure and the possibility of the bricks becoming dislodged from the cooling element when subjected to high furnace temperatures. It is well known that the high furnace temperatures result in a distortion of the cast iron body. While the cast iron body and the refractory brick lining distort in a non-complementary manner to each other, with the novel structural relationship between the brick and the cooling element, they are held together in the furnace.

The cooling element or unit can be simply composed as pre-fabricated individual bricks, can be merely inserted into the recesses and preferably mortared thereto. There is no danger of temperature shock as the bricks are inserted into the finished cast body. Neither is there any danger of the bricks being stressed by pressure which in the prior art is produced due to the cast iron body being reduced in volume with falling or decreasing temperature. The short measurement of the individual bricks in relation to the cast body provides the possibility of using a larger palette of brick qualities as refractory materials with coefficients of expansion, which greatly vary from cast iron and can also be used due to the gap.

It must be particularly noted that with this novel construction, the refractory bricks which are inserted into the cooling element can not drop out of the cast body even when the cooling element itself bends towards the inside of the furnace due to thermal stress during operation. The bricks are also then held in position due to the inwardly widening recess, and the correspondingly widening cross-section of the refractory bricks mate with the recess. In conjunction with this, a cast body composed of nodular graphite with higher silicon contents has further particular advantages as the bending in this case is restricted.

Bending is restricted because the cast iron with nodular graphite has a higher consistency in growth. It must, however, be considered that such a cast iron with nodular graphite has a clearly reduced thermal conductivity, and therefore, such an alloy does not at first seem suited to the purpose of the cooling element. However, it has in fact been shown that the cooling effect of a cast iron alloy with nodular graphite is sufficient. It has been proved that a considerable improvement in the cooling effect is achieved when additional steps are taken which guarantee a favorable heat transfer between the steel tube with cooling means flowing therethrough and the cast iron body composed of nodular graphite. This favorable heat transfer is guaranteed if a thin multilayered intermediate layer is arranged between the steel tube and the cast body. The multilayered intermediate layer should have a metallic layer of Ni, Co, Mn, or Ag, either individually or in a combination as an alloy, with a thickness of 40 to 100 microns and be applied directly onto the steel tube. A ceramic layer is then applied onto the metallic layer. In particular, a layer of highly stable metallic oxides, e.g. $Al_2O_3$, $TiO_2$, or $ZrO_2$, is then applied onto this metallic layer with a thickness of 30 to 100 microns. These steps are described in more detail in the Applicant's copending parallel application referred to above and based on the application claiming German priorities P 27 17 641.6 of Apr. 21, 1977 and P 27 19 166.8 of Apr. 29, 1977.

The total combination set forth is particularly suited and well adapted to working with fast heat flux densities which flow onto the cooling element. The working life of the cooling element is considerably extended because the bricks which are inserted into the recess exercise their function longer, and thereby the parts of the cast iron body which are situated between the bricks and project towards the furnace also can exercise their cooling function longer.

Other objects, advantages and the nature of the invention will become readily apparent from the detailed description of the preferred embodiment taken in connection with the accompanying drawing.

BRIEF DESCRIPTION OF THE DRAWING

FIG. 1 is a cross-sectional view of a cooling element according to the invention. The recesses in one side of the cooling element are shown sectioned in a dovetailed manner. Four of the dovetailed sections are shown with a refractory lining held therein and the remaining sections are shown without the refractory lining, and it is understood that the other dovetailed sections are intended to be filled with a refractory lining.

FIG. 2 shows a top view of the cooling element of FIG. 1 as viewed from the inside of the furnace; and, FIG. 3 shows an enlarged detailed view of the sectional view shown in FIG. 1.

DESCRIPTION OF THE PREFERRED EMBODIMENT

Referring more particularly to FIGS. 1 and 3, cooling element 1 is formed from a cast iron body 2 having a front surface 3 which faces the interior of a furnace. Cooling element 1 also includes dovetailed recesses 4 which extend from the front surface towards the interior and a steel tube 5 having an inlet and an outlet which pass through the rear surface and face in a direction opposite to the recesses 4.

Recesses 4 are filled with a refractory lining 6 having a shape complementary to the dovetailed opening provided by each recess. The refractory lining is formed from individual bricks 7 which are held within the recesses by a chemically bonding mortar 8 which also serves to fill in the space between the refractory lining 6 and the inner peripheral surface of the cast iron body surrounding the dovetailed recess.

In accordance with the invention the depth of recess 4 is directly related to the distance or spacing 9 between the front surface 3 to the steel tube 5. The dovetailed recess, formed during casting in the cast iron body, only extends about 50% of the distance the surface of steel tube 5 is spaced from the front surface 3.

As best seen in FIG. 3, steel tube 5 is provided with a two layer intermediate layer 10 of the type disclosed in the aforesaid copending application. The first layer 11 of intermediate layer 10 is a metallic layer, and the second layer 12 is a metallic oxide layer.

Referring to FIG. 2 which shows a plurality of the individual bricks 7 inserted into each of the recesses 4, it is noted that alternate rows of refractory brick linings and the face of the cast iron body face the interior of the furnace. While only two rows of individual bricks are shown in FIG. 2, the refractory lining 6 and portions of the front surface 3 not removed to provide for the dovetailed recesses alternate from the top downwards over the course of the cooling element 1.

The cooling element 1 as disclosed in the aforesaid copending application is composed of the cast iron body 2 formed from nodular graphite and the steel tube 5 conveys the cooling means or medium. However, according to this invention, the front surface 3 of cast iron body 2 is divided up by the recesses 4 which extend parallel to the wide side of the cooling element 1 and face the interior of the furnace. The dovetailed recesses 4 have a cross-section which widens out conically towards the inside of the cooling element 1.

As best seen in FIG. 1, the individual brick 7 has a short measurement in relation to the cross-section of the recess 4. The chemically-bonding mortar 8 is arranged between the individual brick 7 and the recess 4 so that the brick 7 forms a unitary structure with the cast iron body 2 and the brick 7 is anchored to the interior of the recess 4.

The space 9 between the front surface 3 on the furnace side of the cooling element and the steel tube 5 should be approximately twice the depth of the recess 4. The top view according to FIG. 2 shows that the front side on the furnace side of the cooling element 1 is provided with about 50% of the refractory lining 6, and the remaining 50% is provided by surface 3 of the cast iron body 2.

As best seen in FIG. 1, the refractory lining surface terminates flush with the front surface 3. This flush termination takes into account the variations in the expansional behavior of the cooling element 1, which is secured on the steel jacket in relation to the brickwork which is arranged in front of the cooling elements 1 and towards the inside of the furnace.

The first layer 11 can be formed, for example, from nickel which is applied directly onto the steel tube 5 with a thickness of 70 microns, and the second layer 12 can be formed for example from $Al_2O_3$. The second layer 12 has a thickness of about 50 microns.

This two-layer construction guarantees a very thin intermediate layer 10. The layer 12 which is responsible for an inferior thermal conductivity is restricted in its actual thickness to a gap width of only 50 microns. A particularly good cooling effect is thereby produced so that the cast iron with nodular graphite can be used for the cast iron body which in turn has an advantageous effect on the consistency in shape and on the position of the refractory lining 6 in the recesses 4.

While there has been shown and described what is considered to be a preferred embodiment of the invention and the best mode for carrying out the invention, it will be obvious that various changes and modifications may be made therein without departing from the scope of the invention.

We claim:

1. A cooling element for a metallurgical furnace, said cooling element including a cast iron body having a front surface provided with recessed portions and a refractory lining facing the interior of the furnace received within said cast iron body and terminating substantially flush with the plane of the front surface of said cast iron body, said cooling element having steel tubes for conveying a cooling fluid medium anchored in said cast iron body towards the rear surface thereof away from and spaced from said refractory lining, said recessed portions having a cross-section which widens from the front surface of the cast iron body towards the rear thereof, said refractory lining has a cross-section which substantially corresponds to the cross-section of said recessed portions and including a short measurement, said refractory lining being inserted into said recessed portions forming a space between said received refractory lining and the inner peripheral surface of said recessed portions, and mortar filling said space and holding said refractory lining to said cast iron body facing the interior of the furnace.

2. The cooling element as claimed in claim 1, wherein:

the depth of said recess portion amounts to $\frac{1}{3}$ to $\frac{2}{3}$ of the distance between the steel tube and the front surface.

3. The cooling element as claimed in claim 2, wherein the space between the surface of said tube and said front surface varies between 110 mm and 140 mm, and the depth of said recessed portion varies between 45% and 55% of said space distance.

4. The cooling element as claimed in claim 2, wherein the space between the surface of said tube and said front surface is about twice the depth of said recess.

5. The cooling element according to claim 1, wherein said front surface has an area of from 30% to 70% formed from said refractory lining and the remainder formed from the surface of said cast iron body.

6. The cooling element according to claim 1, wherein said refractory lining includes individual bricks and the cross-section of each said brick corresponds to the cross-section of said recess.

7. The cooling element according to claim 1, wherein said recessed portion having a conical form widens out in dovetailed manner from said front surface away therefrom, and said short measurement being between 1 and 3.5 mm and said conical form is below 8 mm.

8. The cooling element according to claim 1, wherein said cast iron body is composed of a cast iron alloy with nodular graphite.

9. The cooling element according to claim 1, wherein said cast iron body is formed from nodular graphite containing 2.1% to 5.3% by weight of silicon and 2.5% to 4.0% by weight of carbon.

10. The cooling element as claimed in claim 1, wherein said recessed portions extend in a direction parallel to the wide side of the cooling element and alternate with non-recessed portions therebetween, thereby presenting an alternating pattern of refractory lining and cast iron body surface facing the interior of the furnace.

11. The cooling element as claimed in claim 1, wherein:

said mortar is a chemically-bonding mortar.

* * * * *